United States Patent [19]

Young et al.

[11] Patent Number: 4,863,134

[45] Date of Patent: Sep. 5, 1989

[54] COMBINATION CUP HOLDER AND ARMREST

[75] Inventors: John R. Young, Kansas City, Mo.; Larry L. Jacobson, Shawnee, Kans.

[73] Assignee: American Multi-Cinema, Inc., Kansas City, Mo.

[21] Appl. No.: 211,139

[22] Filed: Jun. 22, 1988

Related U.S. Application Data

[63] Continuation of Ser. No. 127,623, Nov. 30, 1987, abandoned, which is a continuation of Ser. No. 852,124, Apr. 15, 1986, abandoned.

[51] Int. Cl.[4] ..... A47C 7/68

[52] U.S. Cl. ..... 248/311.2; 248/118; 297/194

[58] Field of Search ..... 248/311.2, 309.1, 310, 248/118, 314, 220.2; 297/194, 188, 115, 153, 160, 416, 414

[56] References Cited

U.S. PATENT DOCUMENTS

| | | | |
|---|---|---|---|
| 2,419,412 | 4/1947 | McArthur . | |
| 2,963,256 | 12/1960 | Borah | 248/314 |
| 3,045,962 | 7/1962 | Paulus | 248/314 X |
| 3,215,467 | 11/1965 | McFarland . | |
| 3,233,940 | 2/1966 | Tooley, Jr. . | |
| 3,675,969 | 7/1972 | Gage | 297/194 |
| 3,690,724 | 9/1972 | Douglas et al. | 297/194 |
| 4,174,866 | 11/1979 | Rhyan | 297/194 |
| 4,262,962 | 4/1981 | Yust | 297/194 |
| 4,548,326 | 10/1985 | Danna et al. | 297/194 |
| 4,721,216 | 1/1988 | Kinder | 248/311.2 X |

FOREIGN PATENT DOCUMENTS

| | | | |
|---|---|---|---|
| 1252563 | 11/1971 | United Kingdom | 248/311.2 |

*Primary Examiner*—Ramon S. Britts
*Assistant Examiner*—Karen J. Chotkowski
*Attorney, Agent, or Firm*—Litman McMahon & Brown

[57] ABSTRACT

A combination cup holder and armrest is provided for attachment to a chair arm. Typically, the chair arm is shared by adjacent theater or stadium chairs, or the like. The cup holder is integral with the armrest and extends beyond an outer end of the chair arm. The cup holder includes a receptacle, which defines two coaxial bores having different diameters, with a ring step therebetween. The bores are sized to receive a plurality of different sized cups in a stable manner. The inner walls of the receptacle, which define the coaxial bores, are slanted toward a center of the bores. The angle of slant generally conforms to an angle of slant associated with the outer surface of a subject cup, whereby surface contact is obtained between the cup and the receptacle.

13 Claims, 2 Drawing Sheets

COMBINATION CUP HOLDER AND ARMREST

CROSS REFERENCE TO RELATED APPLICATIONS

The present application is a continuation of U.S. Ser. No. 127,623 filed Nov. 30, 1987, now abandoned, which was a continuation of Ser. No. 852,124, filed Apr. 15,1986, now abandoned.

This invention relates to attachments for chair arms in general and particularly to chair arm attachments having a cup receptacle that accommodates various sizes of beverage containers.

BACKGROUND OF THE INVENTION

Today's movie theater, as one of the premier public entertainment attractions, draws a great number of viewers throughout the year. Many spectators find that the pleasure of viewing the film is enhanced by consuming refreshments, such as candy, popcorn, and soft drinks of various sizes. Often the movie viewer becomes tired of holding the soft drink in his (or her) hand, or he may find holding the soft drink cumbersome when also trying to eat popcorn or candy. Thus, he must set the soft drink down on the floor where it may be accidentally kicked over in the darkness and spilled, or on the chair arm where it may easily be knocked over. The juggling of these refreshments is often frustrating and may detract from the spectator's enjoyment of the film.

Because of these conditions, it is desirable to have available to the spectator a receptacle in which to place the soft drink out of harm's way, but within the reach of the spectator. It is also desirable to fashion such a device to accommodate the placement of various sizes of soft drink containers and that such a device be stable and immobile so as to prevent dislodgement of the device by inadvertent movement.

OBJECTS OF THE INVENTION

The principal objects of the present invention are: to provide a device which receives various sizes of standard cups; to provide such a device which maintains various sizes of beverage cups within easy grasp of the chair occupant while maintaining stability of the cup; to provide such a device which extends a minimal distance into the aisle area between parallel rows of seats; to provide such a device which securely attaches to an existing theater chair; and to provide such a device which is relatively simple to use, economical to manufacture and particularly well adapted for the proposed usage thereof.

Other objects and advantages of this invention will become apparent from the following description taken in conjunction with the accompanying drawings wherein are set forth, by way of illustration and example, certain embodiments of this invention.

SUMMARY OF THE INVENTION

A combination cup holder and armrest is provided for attachment to a chair arm. Typically, the chair arm is shared by adjacent theater or stadium chairs. The cup holder is preferably integral with the armrest and extends beyond an outer end of the chair arm to facilitate receipt of cups and the like. The cup holder includes a receptacle, which includes inner walls that define respective first and second coaxial bores, or orifices, having different diameters with a ring step therebetween. The bores are sized to receive a plurality of different sized cups in a stable manner. Thus, the cup receptacle yields an efficient multi-sized cup holding configuration. The inner walls of the receptacle, which define the coaxial bores, are slanted toward a center of the bores. The angle of slant generally conforms to an angle of slant associated with the outer surface of a subject cup whereby adequate surface contact is maintained between the cup and the receptacle. This protects the wall of the cup from collapse that could occur if the contact area was too small or relatively pointed.

The drawings constitute a part of this specification and include exemplary embodiments of the present invention and illustrate various objects and features thereof.

DETAILED DESCRIPTION OF THE INVENTION

Figure 1:
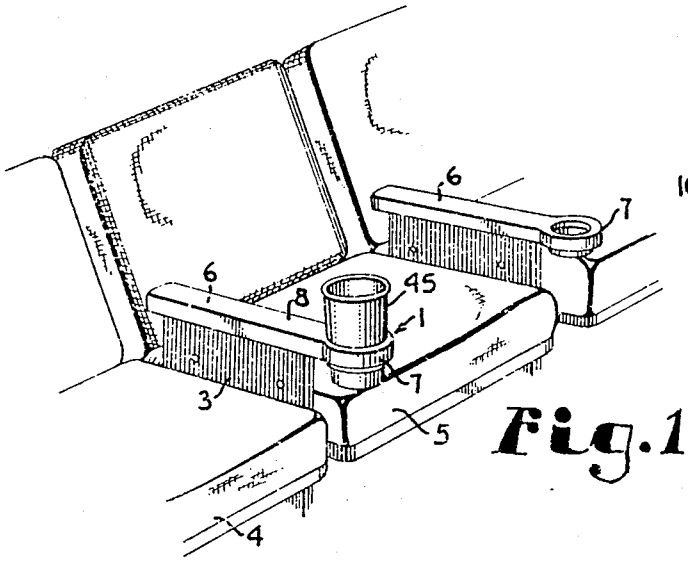
FIG. 1 is a perspective view showing a typical seating arrangement and a combination cup holder and armrest affixed to a chair arm.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1, FIG. 1, generally indicates a combination cup holder and armrest secured to a chair arm 3, which is shared by adjacent chairs 4 and 5.

Figure 2:
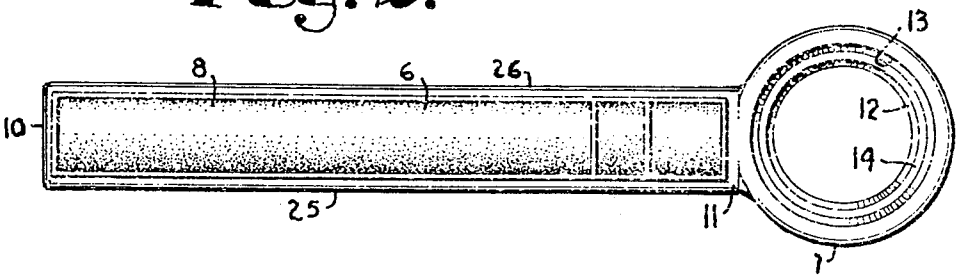
FIG. 2 is a top plan view of the combination cup holder and armrest according to the present invention.
Figure 3:
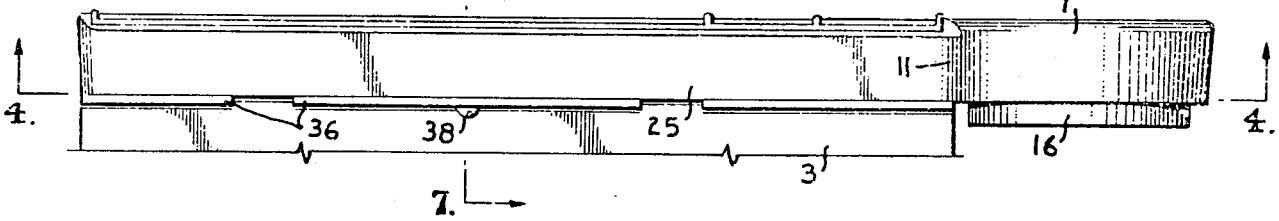
FIG. 3 is a fragmentary, enlarged side elevational view of the combination cup holder and armrest in position on the chair arm.

The holder and armrest 1 has an armrest section including an elongate beam member 6, and a cup holder section including a cup receptacle 7. The beam member 6 has a top surface 8 (FIG. 2), a bottom surface 9 (FIG.

4), and proximal and distal ends 10 and 11. Preferably, the distal end 11 is integral with the cup receptacle 7.

The cup receptacle 7 defines two coaxial bores, an inner or first bore 12 defined by a first wall 16 and an outer or second bore 13 defined by a second wall 17. The coincidental axis of the bores 12 and 13 passes through the center of the bores. The axis of the bores is generally vertical. An annular ring 14 forms a step between the inner and outer bores 12 and 13. The outer bore 13 has a diameter that is greater than the diameter of the inner bore 12, as is evident from the drawings. Thus, various sizes of cups can be accommodated by the cup holder as will be discussed in more detail with respect to FIGS. 8, 9, and 10.

Figures 5, 6, 7, 8, 9, 10:
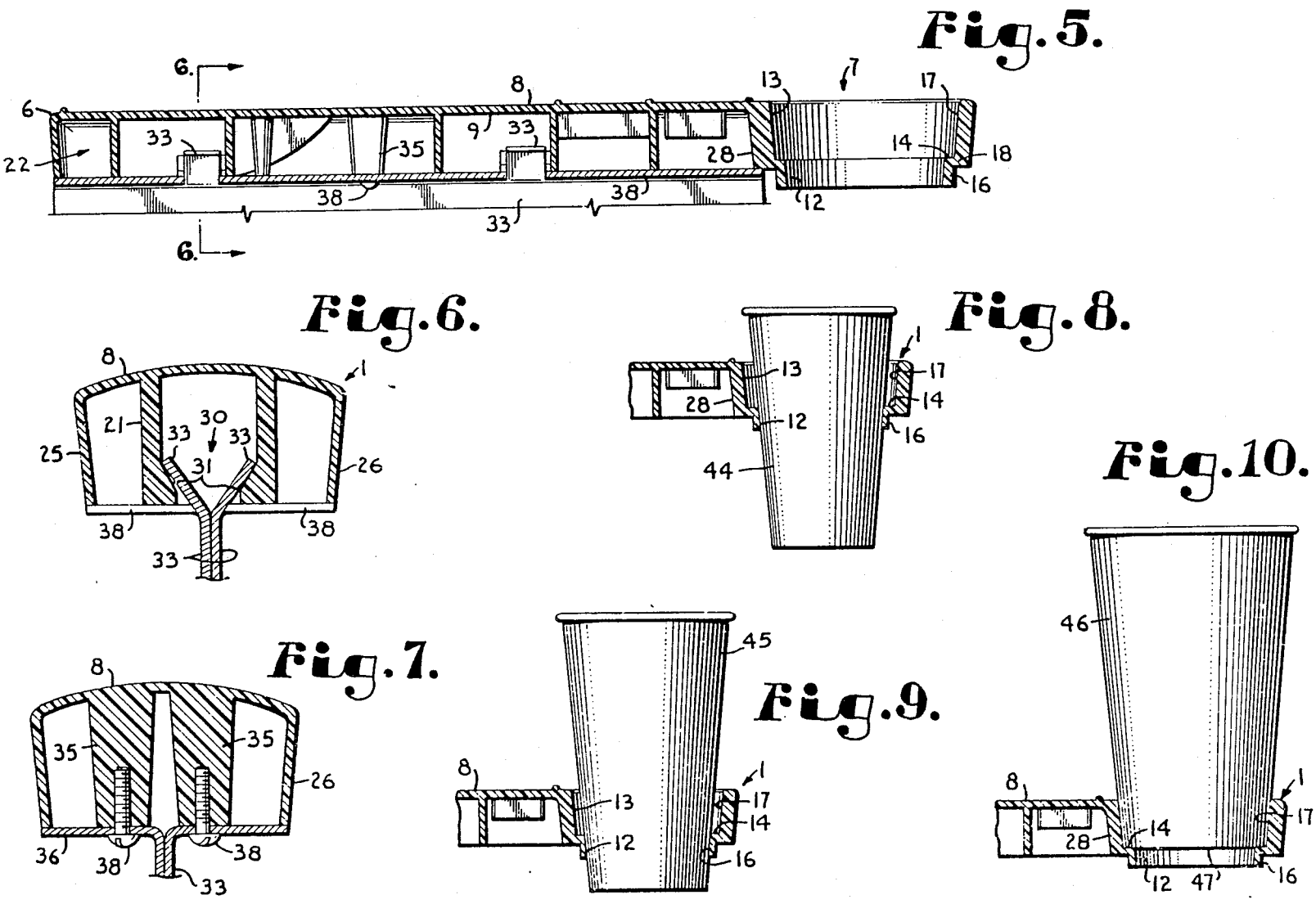
FIG. 5 is a cross-sectional view of the combination cup holder and armrest taken along line 5—5, FIG. 4.
FIG. 6 is an enlarged cross-sectional view of the present invention taken along line 6—6, FIG. 5.
FIG. 7 is an enlarged cross-sectional view of the present invention taken along line 7—7, FIG. 3.
FIG. 8 is a fragmentary sectional view of the present invention employed in its intended usage, and indicating the manner in which a relatively small-size cup is held in a cup receptacle.
FIG. 9 is a fragmentary sectional view of the present invention employed in its intended usage, and indicating the manner in which a relatively medium-size cup is held in the cup receptacle.
FIG. 10 is a fragmentary sectional view of the present invention employed in its intended usage, and indicating the manner in which a relatively large-size cup is held in the cup receptacle.

The first wall 16 defining the inner bore 12 depends from a main body 18 of the cup receptacle 7, as seen in FIG. 5. The extension that the first wall 16 provides from the main body 18 increases the surface area of the inner bore 12 that is available for contacting a received cup. The second wall 17 extends generally from the top surface 8 down to the annular ring 14, such that the larger diameter outer bore 13 is positioned above the inner bore 12.

In order to increase the surface area of contact between the received cup and either the inner or outer bores 12 and 13, the surfaces of the inner and outer bores 12 and 13 slope toward the center of the bores 12 and 13. Preferably, the preferred angle of slope is in the range of two to three degrees (2° to 3° ) from the vertical. The desired angle of the slope generally corresponds to an angle of slope prevalent in many soft drink cups used in theaters and the like. It is envisioned that this angle could be varied to conform to a particular slope of subject cups sold at a particular establishment, depending upon the circumstances.

Figure 4:
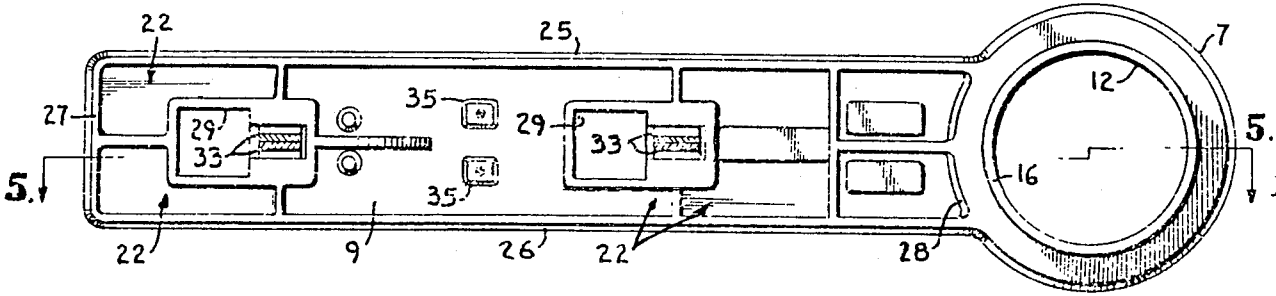
FIG. 4 is a cross-sectional view taken along line 4—4, FIG. 3, showing a pattern of indentations, bosses and structures that serve as the means of attachment of the present invention to the chair arm.

As seen in FIG. 4, structure elements 21 depend from the bottom surface 9 of the elongate beam member 6 and define a pattern of cavities 22. The structure elements 21 and cavities 22 cooperate with a corresponding configuration of recesses and projections in the chair arm 3 whereby the holder and armrest 1 can be secured to the chair arm 3. In particular, the cavities 22 are further defined by four depending walls, including side walls 25 and 26, proximal end wall 27 and distal end wall 28.

Each of structure elements 21 includes an insert chamber 29 and an adjacent locking chamber 30 for mating with the chair arm 3. The locking chamber 30 is defined by wedge-shaped gripping members 31, which are integral with the remainder of the structure element 21. In use, each structure element 21 is formed to permit a pair of chair arm tabs 33 (FIG. 6) to be received into the insert chamber 29 and then into the locking chamber 30, wherein the tabs 33 are locked into place by the wedge-shaped gripping members 31.

The depending structure elements also include a plurality of bosses 35 for securing the combination cup holder and armrest 1 to the chair arm 3. FIG. 7 illustrates how the bosses 23 are secured to a chair arm beam 36 by screws 38. The depending structure elements 21 are not limited to the specific pattern described herein and illustrated in the drawings, but can include any number or combination of the like to be used in securing the cup holder and armrest 1 to the chair arm 3.

The holder and armrest 1 is composed of any durable plastic material, preferably inflexible and water resistant.

FIG. 8 illustrates the use of the cup receptacle 7 in maintaining a relatively small-sized cup 44 in place. The inner bore 12 slopes to meet the angle of the cup 44 at the mid section, thereby suspending it in place.

FIG. 9 illustrates the use of the cup receptacle 7 in maintaining a relatively medium-sized cup 45 in place. The inner bore 12 slopes to maintain the base of the cup 45 in position.

FIG. 10 illustrates the use of the cup receptacle 7 in maintaining a relatively large-sized cup 46 in position. The cup 46 rests on the annular ring 14, which forms a step between the inner and outer bores 12 and 13. A base 47 of the cup 46 is secured by sloping walls of the outer bore 13. Thus, it is seen that many different sizes of cups can readily be accommodated by the present invention.

It is envisioned that additional bore-defining walls could be included to provide for more flexibility in receiving cups of larger and smaller sizes.

It is to be understood that while certain forms of the present invention have been illustrated and described herein, it is not to be limited to the specific forms or arrangement of parts described and shown.

What is claimed and desired to be secured by Letters Patent is as follows:

1. A cup holder and armrest apparatus for attachment to a chair arm in combination with a set of cups including a relatively small size cup having a top, a bottom and a tapered exterior side surface with a bottom diameter smaller than a top diameter thereof; and a relatively large size cup having a bottom with a bottom diameter larger than said small cup bottom diameter associated therewith, said apparatus alternatively supporting members from said set of cups; said combination cup holder and armrest comprising;

(a) an armrest section for attachment to the chair arm;

(b) a cup holder section connected to said armrest section; said cup holder section, when said apparatus is in an operational configuration thereof, including a first wall defining an inner bore substantially vertically aligned and extending entirely vertically through said cup holder section; said inner bore being substantially open and free of vertical restriction; said inner bore having a diameter sized between said small size cup bottom and top diameters such that when said small size cup is positioned in said inner bore, said small size cup is interferingly held by said small bore between said small size cup top and bottom;

(c) said cup holder section including a second wall positioned above said first wall and defining an upwardly-open outer bore; said inner and outer bores being substantially coaxial, with a common axis thereof being generally vertical; said outer bore having a diameter generally greater than a diameter of said inner bore so as to form a shoulder between said inner and outer bores with a surface of said shoulder facing generally upward; said outer bore having a diameter at least as large as said large size cup bottom diameter; and (d) said shoulder engaging and supporting a base of said large size cup, when placed thereon, so as to substantially support said large size cup from beneath rather than from a side wall thereof whereby said large size cup extends upward from said outer bore and is supported by said cup holder section shoulder; and (e) attachment means for fixedly attaching said arm rest section to the chair arm.

2. The combination cup holder and armrest as set forth in claim 1 wherein:

(a) said first wall slopes from a top section thereof to said annular ring and toward the axis of said inner and outer bores; and (b) said first wall slopes from said step to a bottom section of said wall and toward the axis of said inner and outer bores.

3. The combination cup holder and armrest as set forth in claim 2 wherein:

(a) said first wall slopes at an angle of between approximately two and three degrees from the vertical; and (b) said second wall slopes at an angle of between approximately two and three degrees from the vertical.

4. The combination cup holder and armrest as set forth in claim 1 wherein said first wall depends from a main body of said cup holding section, whereby the effective surface area of said inner bore is increased.

5. The combination cup holder and armrest as set forth in claim 1 wherein:

(a) said armrest section is an elongate beam member having proximal and distal ends;

(b) said cup holder section is integral with said beam member distal end; and (c) said beam member has a bottom surface from which a structure element depends for cooperating with a corresponding projection on said chair arm to secure said combination cup holder and armrest to said chair arm.

6. The combination cup holder and armrest as set forth in claim 5 wherein:

(a) said structure element includes an insert chamber;

(b) said structure element includes a locking chamber adjacent said insert chamber and including wedge-shaped ripping members; and (c) said insert chamber is adapted to receive a portion of said chair arm to position it for insertion into said locking chamber, whereby said combination cup holder and armrest is secured to said chair arm.

7. The apparatus according to claim 1 wherein:

(a) said armrest section includes a top surface, a bottom surface and depending side and end walls; and further comprising:

(b) a structure element attached to and depending from the bottom surface of said armrest section; said structure element including an insert chamber and a locking chamber for receiving and mating with a chair arm tab, whereby said combination cup holder and armrest is adapted to be secured to the chair arm, said insert and locking chambers being longitudinally aligned;

(c) said cup holder section is integrally connected to said armrest section and extends beyond an outer end of the chair arm when said combination cup holder and armrest is attached thereto; and (d) said outer bore having a top surface continuous with said armrest section top surface.

8. A combination cup holder and armrest as set forth in claim 7 wherein said locking chamber includes a pair of wedge-shaped gripping members for securely receiving said chair arm tabs.

9. The combination cup holder and armrest as set forth in claim 7 wherein both of said first and second walls slope downwardly and toward the coincidental axis of said inner and outer bores.

10. The combination cup holder and armrest as set forth in claim 7 further including a boss depending from said armrest section and adapted to be secured to said chair arm.

11. The apparatus according to claim 1 in combination with a chair including a chair arm beam and a tab projecting upwardly therefrom wherein:

(a) said armrest section includes;

(1) a top surface;

(2) a bottom surface;

(3) depending side walls; and (4) depending end walls; and said combination further comprising:

(b) a structure element attached to and depending from the bottom surface of the armrest section and including:

(1) a downwardly-open insert chamber adapted to be wider than said tab so as to receive said chair arm tab without substantial deformation of the tab when said armrest section is lowered onto said chair arm;

(2) a downwardly-open locking chamber separate from but substantially positioned adjacent to said insert chamber and being longitudinally aligned and communicating with said insert chamber, said locking chamber including a downwardly and inwardly sloping wedge-shaped gripping member, said gripping member separating an upper portion and a bottom opening of said locking chamber whereby said bottom opening is narrower than said locking chamber upper portion and is adapted to be narrower than the tab such that when the tab is positioned within the locking chamber the tab cannot be readily urged through said bottom opening; and (3) said locking chamber being adapted to longitudinally, slidably receive said chair arm tab whereby said armrest section is retained against lifting from said chair arm; and (c) said cup holder section integrally connected to said armrest section and extending beyond an outer end of the chair arm when said combination cup holder and armrest is attached thereto.

12. An armrest and cupholder apparatus for use in conjunction with a theater seat and having an operational configuration when secured to a theater seat; said apparatus comprising:

(a) an elongate armrest section adapted to support an arm of a user;

(b) fastening means for securing said elongate section to an associated chair;

(c) a cup holder section adapted to support cups having a plurality of different diameters; said cupholder section being secured to and extending outward from said armrest section; and (d) said cupholder section having a vertical bore extending entirely therethrough when said apparatus is in the operational configuration thereof; said bore having a lower portion and an upper portion and being free of vertical obstruction; said upper portion having a substantially larger diameter than said lower portion so as to define a shoulder therebetween; and said shoulder being adapted to support cups of one diameter and said lower bore being adapted to capture and support a cup having a sloping side wall and being of a smaller diameter than the cups supported by said shoulder through engagement of the side wall with said bore such that the smaller diameter cup extends both above and below said bore.

13. The apparatus according to claim 12 wherein:

(a) said armrest section and said cup holder section are integrally joined.

* * * * *